United States Patent [19]

Sargent et al.

[11] Patent Number: 5,010,602

[45] Date of Patent: Apr. 30, 1991

[54] TOILET WITH PULSED FLOW OF FLUSH WATER

[75] Inventors: Charles L. Sargent; John M. Antos; Scott I. Biba, all of Ann Arbor, Mich.

[73] Assignee: Thetford Corporation, Ann Arbor, Mich.

[21] Appl. No.: 553,353

[22] Filed: Jul. 13, 1990

Related U.S. Application Data

[60] Continuation of Ser. No. 471,710, Jan. 29, 1990, abandoned, which is a continuation of Ser. No. 309,776, Feb. 10, 1989, abandoned, which is a division of Ser. No. 114,081, Oct. 27, 1987, abandoned.

[51] Int. Cl.[5] ..... E03D 11/00

[52] U.S. Cl. ..... 4/432; 4/321; 4/329

[58] Field of Search ..... 4/300, 319, 321, 329, 4/330, 332, 431–434, 544; 415/126, 151; 417/44

[56] References Cited

U.S. PATENT DOCUMENTS

| | | | |
|---|---|---|---|
| 4,282,866 | 8/1981 | Miffitt | 4/544 X |
| 4,333,185 | 6/1982 | Heinze et al. | 4/319 |
| 4,516,281 | 5/1985 | MacPherson et al. | 4/321 X |
| 4,710,988 | 12/1987 | Stewart | 4/323 X |

*Primary Examiner*—Charles E. Phillips

*Attorney, Agent, or Firm*—Harness, Dickey & Pierce

[57] ABSTRACT

A portable toilet having a battery operated flushing assembly that is powered by batteries carried in the toilet. The batteries provide for a "pulsed" flushing action of the flush water and this is achieved by the use of an axial flow pump which is operable to lift small amounts of water small distances to the bowl in a repeatable fashion. This facilitates flushing of the toilet, makes it easier for the user to flush the toilet, and provides for efficient and complete flushing. A selectively operable closure plate prevents leakage of water from the toilet bowl during transport of the toilet.

2 Claims, 7 Drawing Sheets

TOILET WITH PULSED FLOW OF FLUSH WATER

This application is a continuation of application Ser. No. 471,710 filed Jan. 29, 1990, now abandoned, which was a continuation of application Ser. No. 309,776 filed Feb. 10, 1989, now abondoned, which was a division of application Ser. No. 114,081 filed Oct. 27, 1987 now abandoned.

BACKGROUND OF THE INVENTION

This invention relates generally to portable toilets and more particularly to a portable toilet which carries its own power supply for operating the flush assembly. U.S. Pat. No. 4,641,383 illustrates a portable toilet of the particular type to which this invention relates. It is conventional practice when flusing portable toilets of this type to utilize manually operable pumps of the bellows type for pumping flush water from a water storage tank in the toilet into the toilet bowl. Pumps of the bellows type are illustrated in prior U.S. Pat. No. 3,570,018 and 3,949,430, all of said prior patents being assigned to the assignee of this application.

Pumps of the bellows type are low cost items which allow water conservation to be observed and have proved to be satisfactory for the needs of portable toilet users. However, there is a need for improved power operated flush assemblies in portable toilets in order to provide for improved flushing of the toilet and also to provide for more efficient use of the flush water supply and enable the use of portable toilets by handicapped or elderly persons that do not have the strength or other physical ability to operate a bellows pump.

U.S. Pat. No. 4,185,337 also assigned to the assignee of this application, shows a portable toilet with an electrically operated flush apparatus but the flush apparatus illustrated in this patent requires an external source of power and involves a continuous flush which has limitations from an efficiency standpoint.

It is the object of this invention, therefore, to provide an improved portable toilet with a battery operated flush assembly.

SUMMARY OF THE INVENTION

The present invention is diredted to a new and improved portable toilet which includes a flush assembly operated by the batteries carried on the toilet. The battery operated flush mechanism is operated by depressing a hollow cap member, somtimes termed a "palm button" and there is a novel lock and unlock mechanism associated with the palm button that is operable to selectively lock the palm button in a position in which it cannot be depressed to flush the toilet and an unlocked position in which it can be selectively depressed to operate the flush mechanism The mechanism includes a "pulsing circuit board" which provides two functions, namely,it senses low batteries and turns on a warning light before the batteries become too low to operate the flush mechanism. In addition, it turns the pump drive motor on and off. The "pulsing circuit board" is operated to turn the motor off and on at predetermined time intervals, such as every second, so as to obtain a "pulsed flush."This type of flush is desirable in that it provides both high velosity water and low velocity water on the flush ledge of the toilet bowl to in turn provide a uniform wetting of the bowl by the flush water.

In addition, the improved flush apparatus of this invention includes an axial flow pump which employs a rotatable propeller which includes a plurality of short spiral vanes. When the propeller is rotated rapidly about its axis, the vanes push the water upwardly into a spiral cavity within the pump housing which in turn directs the flush water into a tube which lifts the water about twelve inches into the top of the toilet bowl. The pump structure is advantageous in that it provides maximum efficiency in terms of use of battery current to lift relatively small amounts of water relatively short distances and pulse it into a toilet bowl. This arrangement provides for prolonged service life of the flush batteries and in addition minimizes the need for frequent refilling of the toil flush water tank.

In the bellows type flush now in common use, it is necessary for the user to apply about a thirty-five pound force to the bellows. If the force is too hard, the flush water shoots out of the supply tube and over the toilet bowl. If the push is not hard enough, a less than satisfactory flush is obtained. The electric flush assembly of this invention requires about a five pound push and provides for repeatable uniform wetting and thorough flushing of the toilet bowl.

On of the hazards involved in using a portable toilet is the possibility of spilling the flush water during transport of the toilet. Unless the flush water is blocked from flowing into the toilet bowl during transport of the toilet, the flush water will inevitably leak from the bowl while the toilet is being carried. One of the advantages of the battery operated flush of this inention is that a closure is provided to oven the water flow path from the flush water tank to the toilet bowl upon initiation of the flush and immediately close the flow path at the end of the flush to thereby prevent undesirable drainage of water through the pump and the toilet bowl during transport of the toilet.

Other toilets have used a check valve which constitutes a restriction in the flow path between the pump and toilet bowl. In a toilet with a manually operated flush mechanism, such a restriction is not objectionable because the same large force that is necessary to operate the manual flush mechanism is also operable to open the check valve. However, in the battery operated assembly of this invention, the objective is to use as little power as possible during flushing so as not to require frequent changing of the batteries. This is accomplished in the battery operated flush assembly of this invention by avoiding the check valve restriction and using a closure which normally closes the flow path between pump and bowl and which is manually opened during initiation of a flush by the same actuator movement that closes the battery switch that in turn initiates the flush operation.

The principal object of this invention, therefore, is to provide an improved battery operated flush assembly for portable toilets which provides for improved flushing action, efficient use of batteries, efficient use of flush water, and prevents leakage of flush water during transport of the toilet.

Further objects, featues and advantages of the invention will become apparent from a consideration of the following description and the appended claims, when taken in connectin with the accompanying drawing in which;

Figure 1:
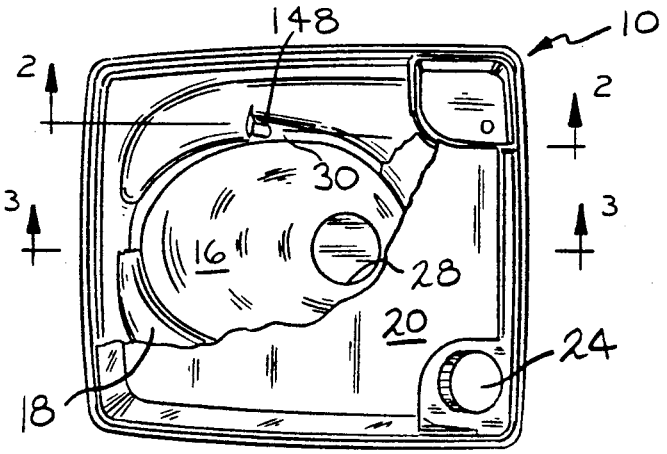
FIG. 1 is a top view of the portable toilet of this invention, with a portion of the seat broken away to show the toilet bowl.
Figure 11:
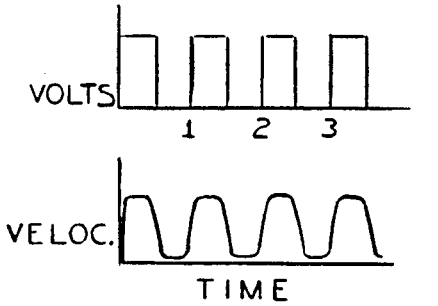
Figure 10:
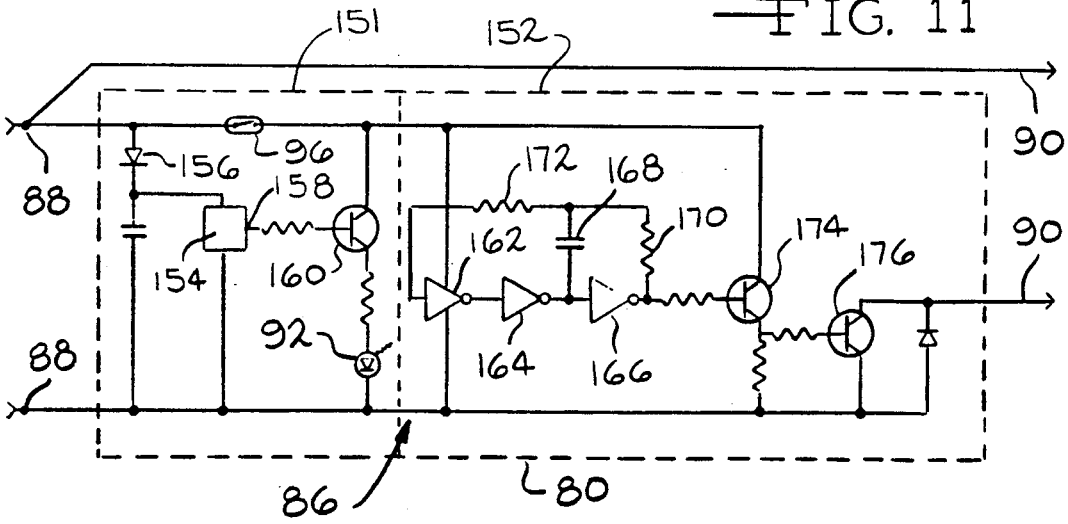
Figure 4:
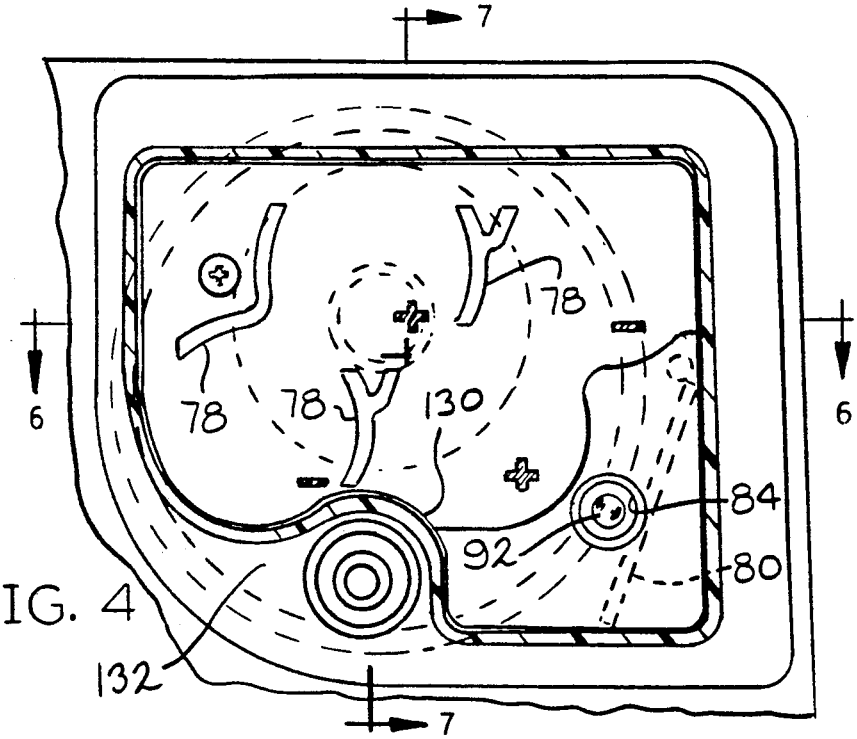
Figure 5:
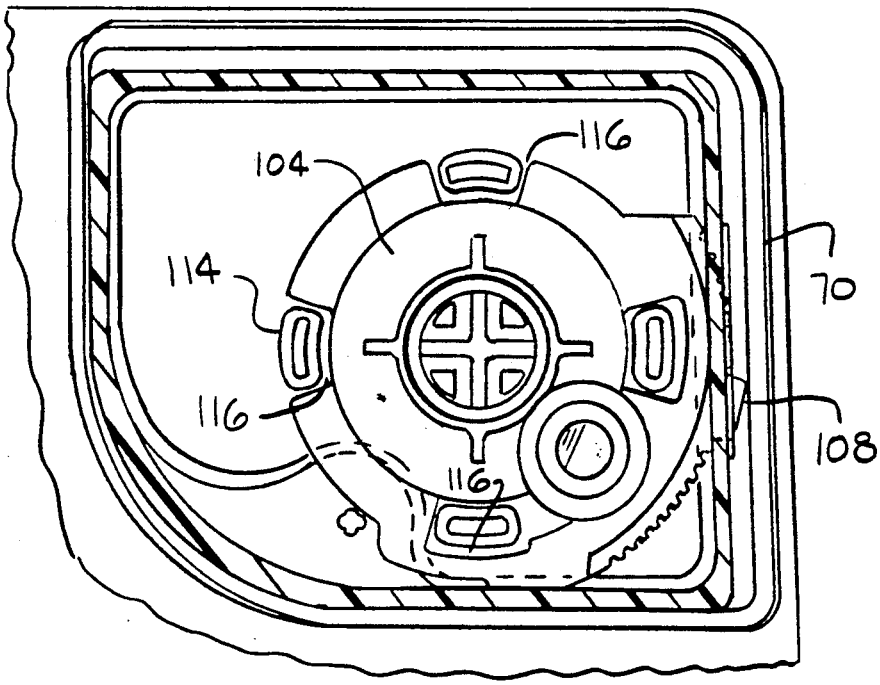
Figure 6:
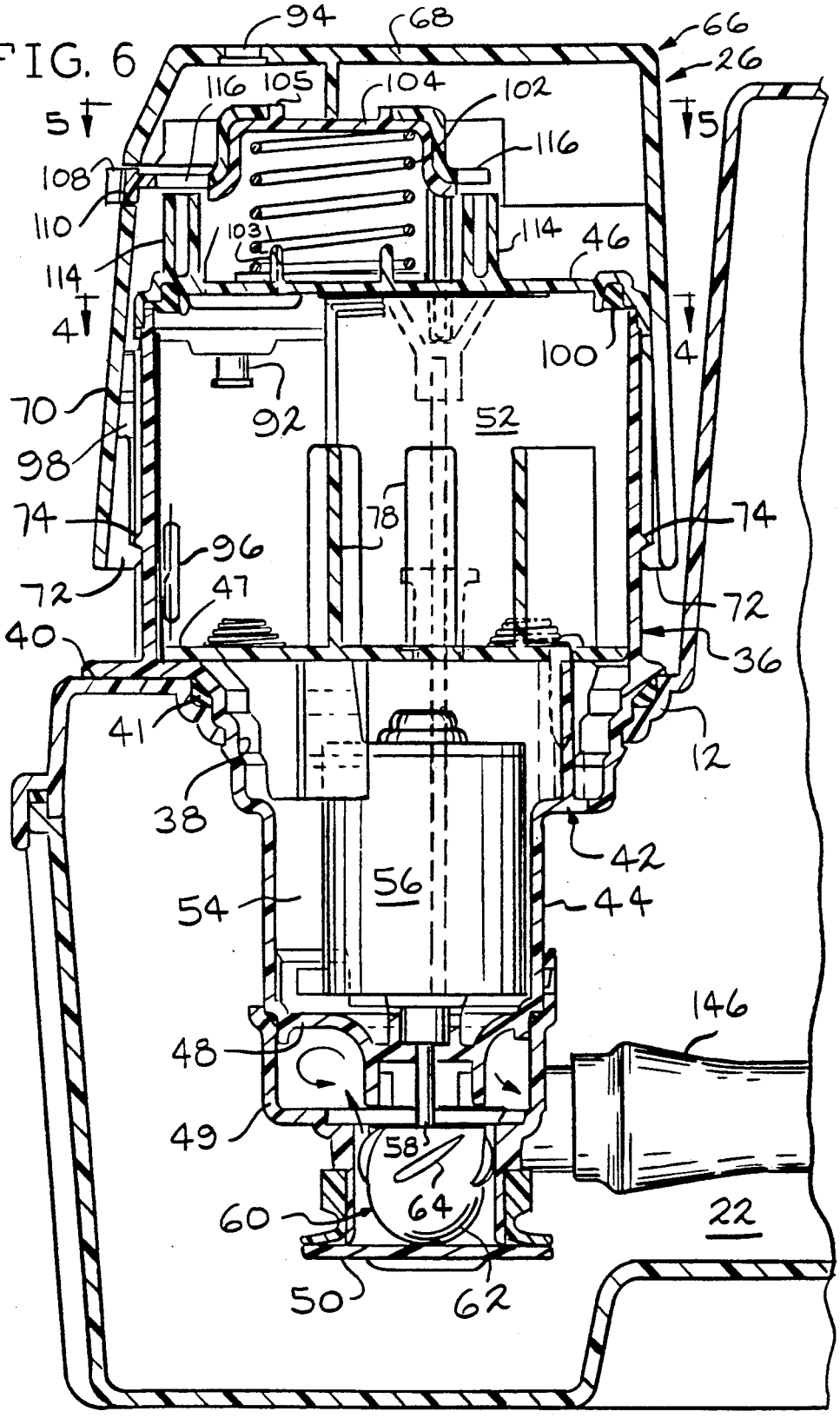
Figure 7:
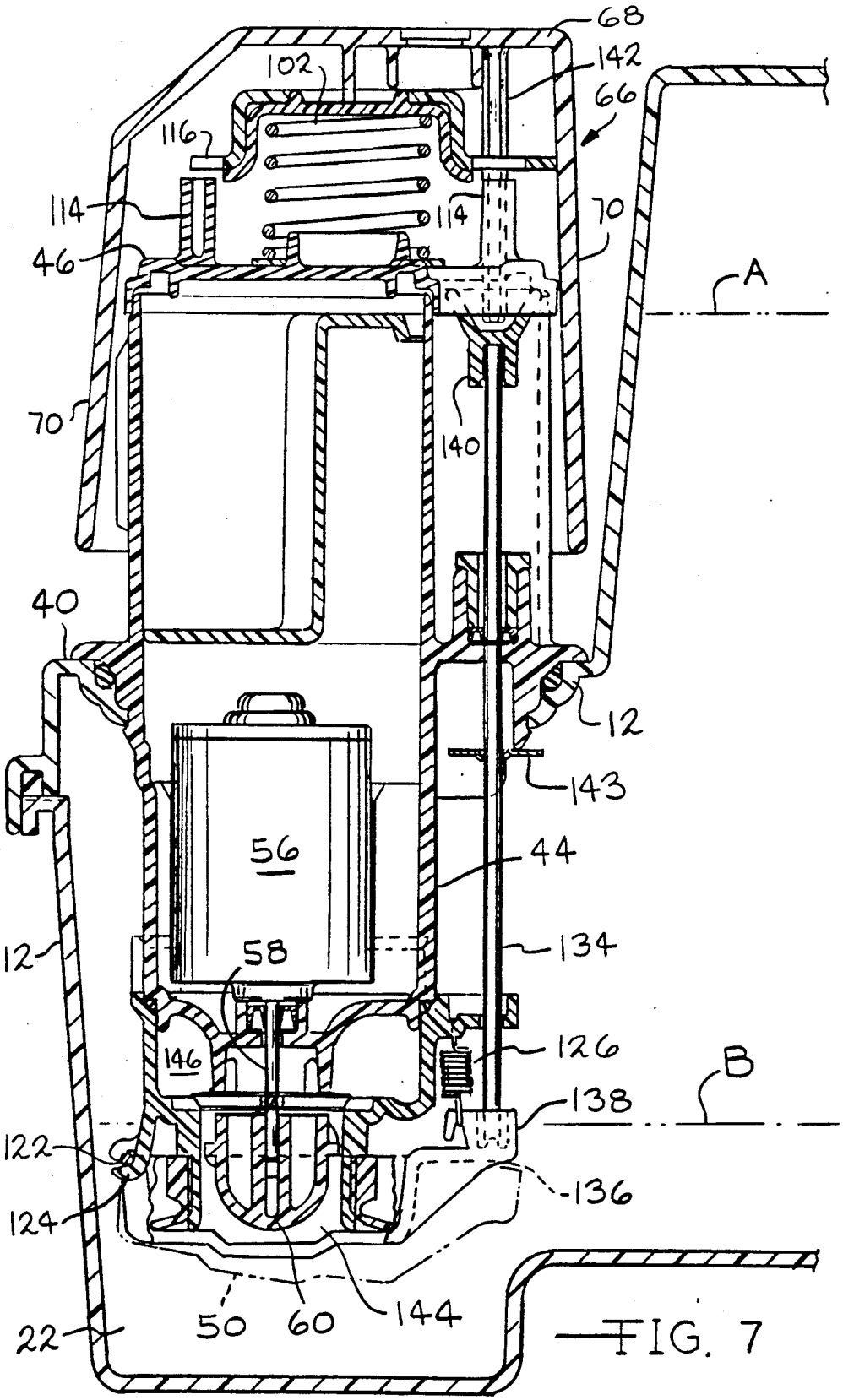
Figures 8, 9:
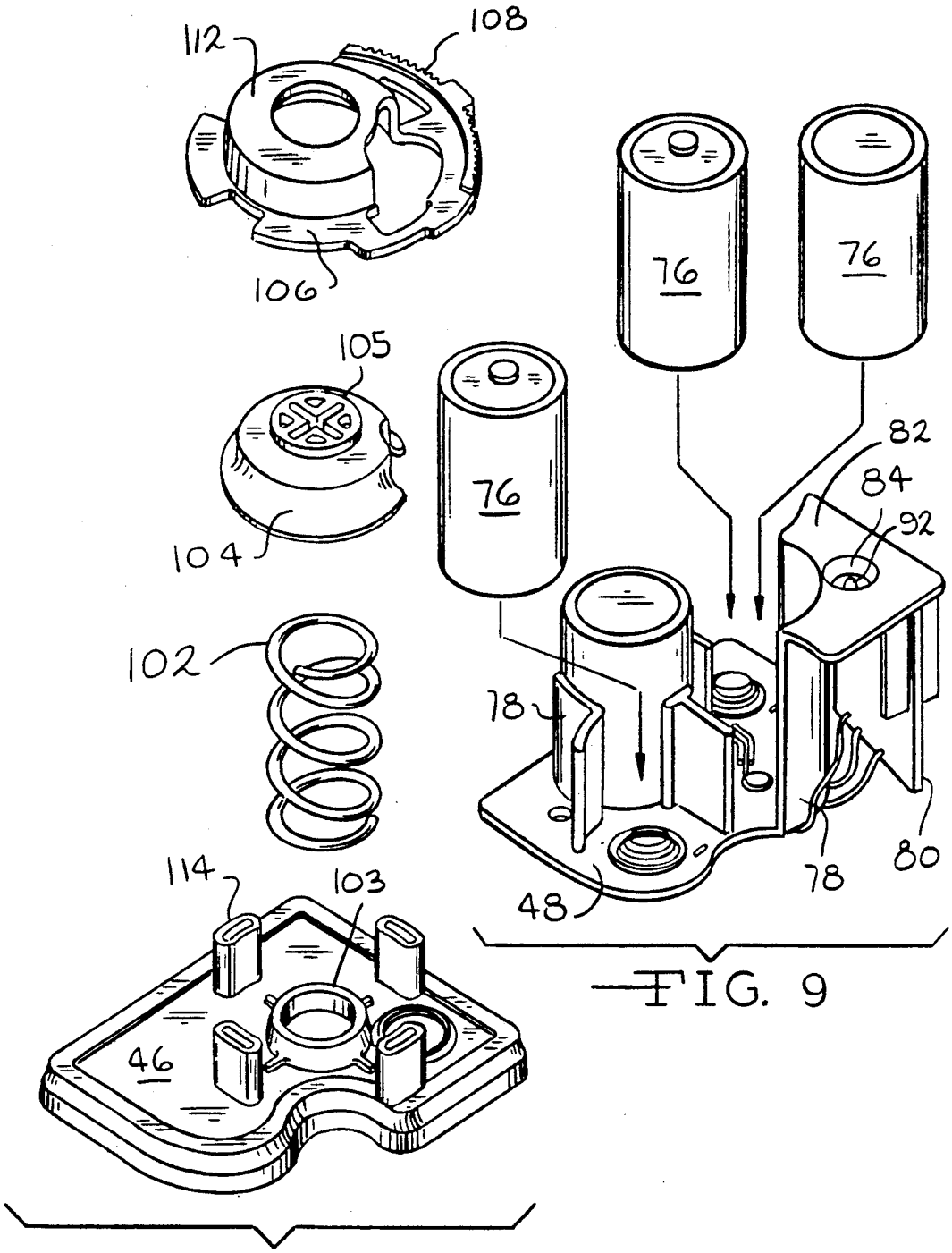

FIGS. 4 and 5 are horizontal sectional views of the flush assembly in the portable toilet of this invention as seen from substantially the lines 4–4 and 5–5, respectively, in FIG. 6;

FIG. 6 is an enlarged vertical sectional view of the portion of the toilet shown in FIG. 1 in which the flush assembly of this invention is embodied;

FIG. 7 is another vertical sectional view of the flush assembly of this invention;

FIGS. 8 and 9 are exploded perspective views of portions of the flush assembly illustrated in FIGS. 6 and 7;

FIG. 10 is a circuit diagram illustrationg the electric circuit in the flush assembly of this invention; and FIG. 11 is a graph illustrating the pulsed flush in the flush assembly of this invention in which voltage and velocity are plotted against time.

Figure 2:
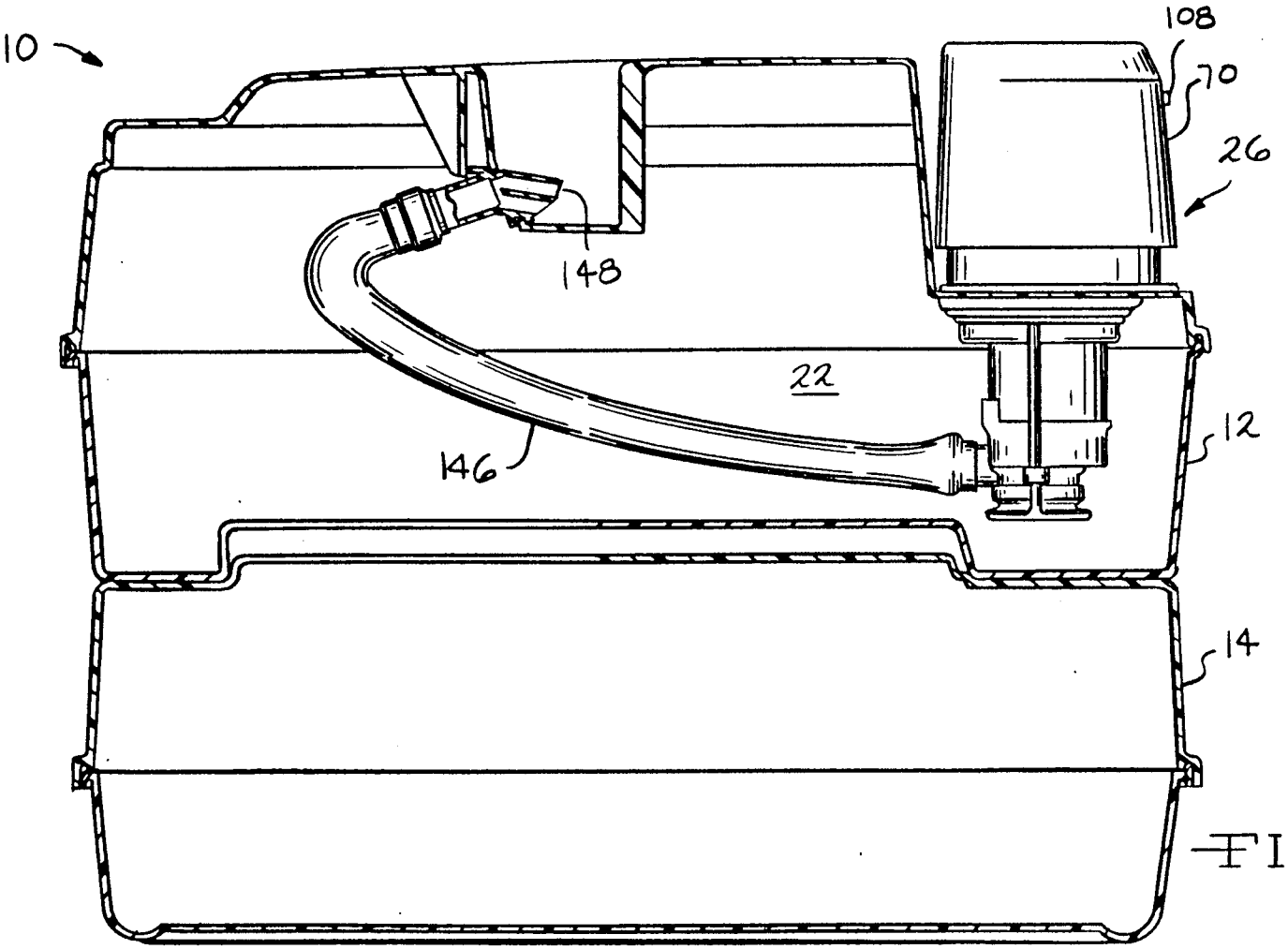
FIG. 2 is an enlarged transverse sectional view of the portable toilet of this invention as seen from substantially the line 2—2 in FIG. 1.
Figure 3:
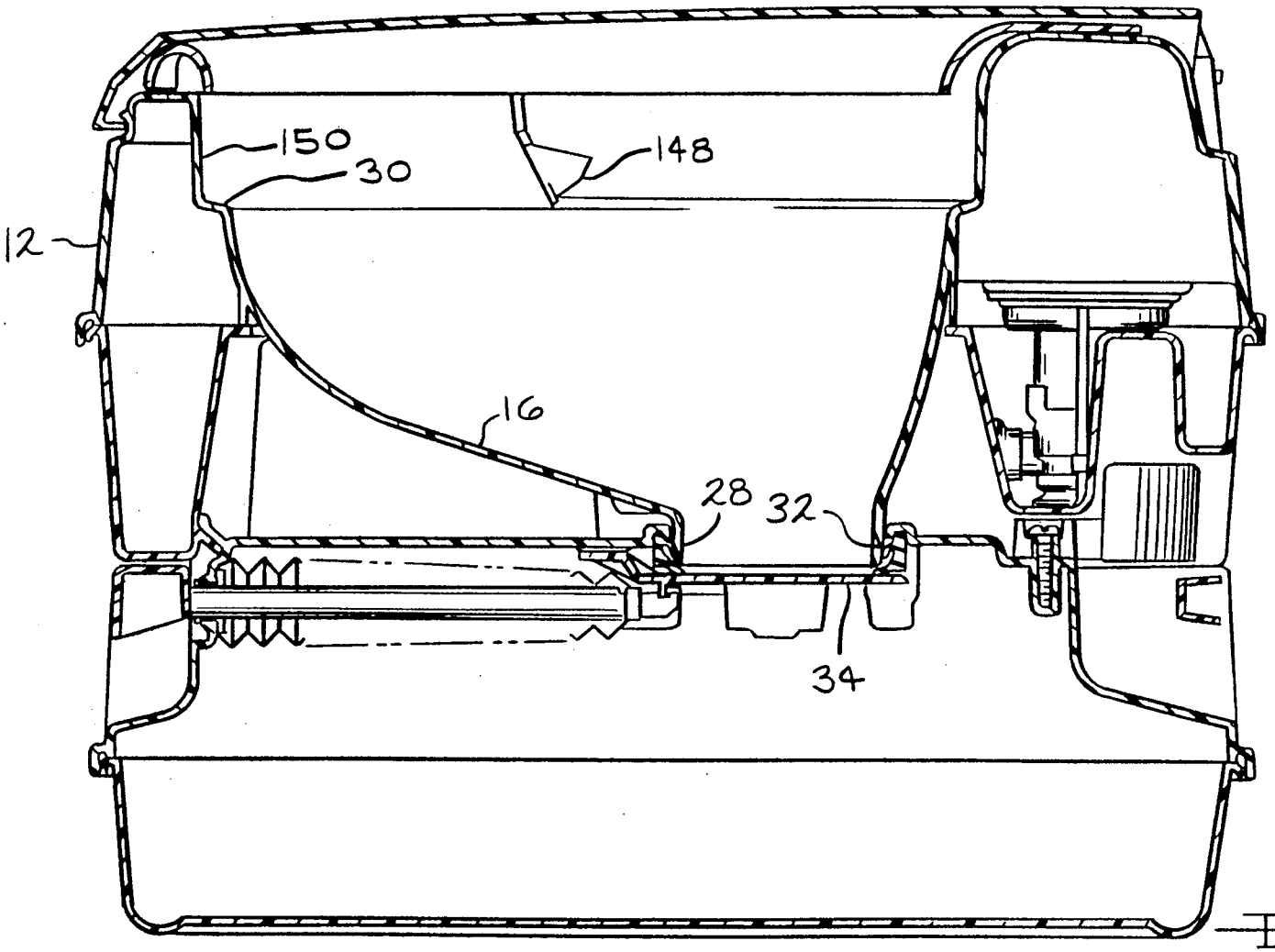
FIG. 3 is an enlarged transverse sectional view of the portable toilet of this invention as seen from substantially the line 3—3 in FIG. 2.

With reference to the drawing, the improved portable toilet of this invention, indicated generally at 10, is illustrated in FIGS. 1 and 2 as including a seat section 12 which separably mounts on a holding tank section 14 in a conventional manner. The seat section 12 includes a bowl 16, and an overlying seat 18 and a cover 20 which are hingedly mounted on the section 12. A flush water storage tank or chamber 22 is provided within the interior of seat section 12 and is filled with fresh water via a fill port which is covered by a removable cap 24. A pumping mechanism indicated generally at 26 is provided for pumping fresh water from the water storage chamber 22 into the bowl 16 in order to flush the toilet. The bowl 16 includes a bottom discharge opening 28 at it s lower end and a flush ledge 30 near its upper end on which flush water is depositied for flow along the ledge and inwardly off the ledge so as to uniformly wet the bowl 16. The discharge opening 28 registers with an inlet opening 32 (FIG. 3) in the top wall of holding tank 14. Opening 32 is closed by a slide valve 34 mounted within the interior of the holding tank 14. Because of the separable mounting of the two sections 12 and 14, the holding tank section 14 can be removed for dumping.

The pump mechanism 26 includes a battery operated pump assembly 36 (FIG. 6) which is mounted on the seat section 12 in an upwardly facing opening 38 in what amounts to the right rear corner of the top surface 40 of the seat section 12. A sealing ring 41 provides for a fluid tight assembly of the pump assembly 36 with the seat section 12.

The pump assembly 36 includes a housing 42 which is generally upright and includes a continuous side wall 44, a top cover plate 46, an intermediate plate 47, and a bottom wall 48. Between the walls 46 and 48, the housing 42 is fluid tight. An enclosure 49 below the housing 42 is open at its lower end and carries a sealing closure plate 50 which normally closes the lower end of the enclosure 49. Between the plates 46 and 47, the housing 42 defines a battery chamber 52 and between the plate 47 and bottom wall 48, the housing 44 defines a chamber 54 in which an electric motor 56 is housed having a downwardly extending drive shaft 59 on which a pump propeller 60 is mounted. The propeller 60 consists of a bullet shaped body 62 having short spiral vanes 64 formed on its outer surface.

Telescoped over the upper end of the housing 42 is an actuator cap 66, sometimes referred to as a "palm button" because it is intended to be depressed with the palm of the hand. The actuator cap has a top wall 68 and a depending skirt 70 and is open at its lower end so that it can readily be telescoped over the upper end of the housing 42.

The lower end of the actuator cap skirt 70 is formed at a plurality of circumferentially spaced points with inwardly directed projections 72 which, when the cap 66 is manually telescoped downwardly over the housing 42, will snap over a corresponding number of outwardly extending projections 74 formed on the housing 42. The cap 66 is formed of a relatively thin guage deflectable plastic material so that the skirt 70 will readily deflect outwardly and spring back inwardly as the projections 72 pass over the projections 74. Similarly, the skirt 70 can be manually grasped and squeezed to deflect the lower end of the skirt 70 outwardly so as to enable the projections 72 to pass over the projections 74 when it is desired to remove the actuator cap 66 from the housing 42.

Four batteries 76 (FIG. 9) are mounted on the plate 47 and housed within the chamber 52. Upright, irregularly shaped, partitions 78 on the plate 47 function to maintain the batteries 76 in upright positions and also cooperate with the housing 42 and its side wall 44 to define an enclosure in which a circit board 80 is housed, the enclosure having a top wall 82 in which an opening 84 is formed for a purpose to appear presently.

The circuit board 80 supports most of the components of the electrical circuit indicated generally by 86 in FIG. 10. The circuit 86 has leads 88 connected to the batteries 76 and leads 90 connected to the electric motor 56. The circuit 86 also includes a warning light LED 92 which is mounted on the wall 82 in alignment with the 84 which is also aligned with an opening 94 in the top wall 68 of the actuator cap 66. The circuit 86 also includes a magnetic reed switch 96 which is mounted in the chamber 52 on the wall 44 of the housing 42 at a position in which, when the actuator cap 66 is depressed, a magnet 98 carried by the actuator cap skirt 70 will actuate the switch 96 so that it will open and close cntinuously so long as the cap 66 is maintained in its depressed position. This opening and closing takes rapidly, for example, on a one-second cycle basis, as illustrated in FIG. 11. As will be described in detail hereinafter, such a condition of the switch 96 will provide for a pulshed flow of flush water from the chamber 22 to the toilet bowl 16. The function of the light 92 is to visually warn the toilet user, that the batteries 76 are low and replacement should be considered.

A cover plate seal 100 mounts the cover plate 46 on the upper end of the housing 42 so as to maintain the chamber 52 in fluid tight condition. A compression spring 102 telescoped over a short post 103 on the plate 46 is maintained in a compressed condition by a retainer cap 104 which has a central round projection 105 in a tongue and groove relationship with a downwardly extending projection 103 on the top wall 68 of the actuator cap 66. The tongue and groove relationship prevents rotation of the cap 66 on the housing 42.

A generally circular thumb wheel 106 has a toothed portion 108 (FIGS. 6 and 8) which projects transversly through a slot 110 in the actuator cap skirt 70. A cap shaped central portion 112 of the thumb wheel 106 telescopes downwardly over the retainer projection 105. This mounting enables rotation of the thumb wheel about the projection 105. As shown in FIGS. 6 and 8, the cover plate 46 is formed with a plurality of upstanding posts 114 which are arranged concentrically around the thumb wheel retainer 104.

As shown in FIG. 5, the posts 114 are vertically aligned with a plurality of openings 116 in the thumb wheel 106, in one rotated position of the thumb wheel 106, thereby enabling the actuator cap 66 and the thumb wheel 106 to be moved downwardly relative to the posts 114. This rotated positon of the thumb wheel 106 corresponds to an "on" condition of the switch 96 because it enables the actuator cap 66 to be moved downwardly to a position in which the magnet 98 will actuate the switch 96. In another rotated position of the thumb wheel 106, the portions of the thumb wheel 106 between the openings 116, are aligned with the posts 114 so that if depression of the actuator cap 66 is attempted, the thumb wheel 106 will engage the posts 114 and prevent movement of the magnet 98 to a position in which it will actuate the switch 96. Thus, such a moved position of the thumb wheel 106 corresponds to an "off" condition of switch 96 and effectively locks the cap 66 in a position in which the toilet can not be inadvertently flushed.

When the actuator cap 66 is depressed to actuate the switch 96 which energizes the motor 56 so as to drive the drive shaft 58 so as to rapidly rotate the propeller 60 about the vertical axis of the shaft 58, it is also necessary to move the closure plate 50 at the lower end of the housing 42 to the open position shown in broken lines in FIG. 7. As shown in FIG. 7 the closure plate 50 includes a shaft 122 which is rotatably mounted in a hinge 124 formed on the lower end of the enclosure 49. The opposite end of the closure plate 50 is connected to a tension spring 126 which is mounted on the enclosure 49. The spring 126 maintains the closure plate in a normally closed position. In order to move the closure plate 50 to its open position, the closure plate has to be moved against the tension force of the spring 126.

As shown in FIGS. 4, the housing wall 44 opposite the battery chamber 52 has an inwardly extending portion 130 which provides a vertically extending space 132 within the cap 66 to one side of the chamber 52. An actuating rod 134 for opening the closure plate 50 in response to downward movement of the actuating cap 66 is provided. The rod 134 has its lower end 136 nested in a cavity in the free end 138 of the closure plate 50. The rod 134 extends upwardly through the plate 47 and at its upper end carries a yieldable cover member 142 which engages the underside of the cover plate 46. An actuator rod 140 on the underside of the top wall 68 of the actuator cap 66 is moveable downwardly, in response to depression of the cap 66, through an opening (not shown) in the cover plate 46 to engage the cover member 140 and move the actuating rod 134 downwardly to in turn pivotally move the closure plate 50 downwardly about the shaft 122 to an open position in which the water in the flush water tank 22 communicates with a pump chamber 144 within housing 49 in which the propeller 60 is located. A stop member 143 is adjustably mounted on rod 134 to limit upward movement of the rod 134. Rapid rotation of the propeller 60 about the vertical axis of the drive shaft 58 causes water from the tank 22 entering the chamber 144 to be moved rapidly upwardly in the chamber 144 into a spiral chamber 146 thereabove for flow in a horizontal direction into the inlet end of a tube 146 which connects the pump to the toilet bowl 16. The outlet end 148 of the tube 146 is positioned directly above and in line with the flush ledge 30. As a result, pulses of water issuing from the tube discharge end 148 will travel around the periphery of the bowl 16 on the ledge 30, and as the water moving on the ledge 30 loses its momentum, and as the velocity of the water decreases, the centrifugal force of the water that is holding it on the ledge 30 and against the outer bowl wall 150 above the ledge 30 (FIG. 3) decreases and the water will gradually run off the inner end of the ledge 30 and down the bowl 16 toward the outlet 28 so as to flush the bowl contents through the opening 28 and throughly wet the inner surface of the bowl 16 so as to accomplish the desired complete flushing of the bowl 16. The normal high and low water levels in the water chamber 22 are shown at A and B in FIG. 7

As shown in FIG. 11 the circuit 86 operates to intermittently reduce the voltage on the motor 56 from a maximum value to zero once every second, the time in seconds being indicated by the numerals 1, 2, 3. This results in the velocity of the pulsed flush water being similarly cycled in 1 second cycles between a maximum velocity and a velocity only slightly greater than zero. The result is a pulsed action of water which is contintuously repeatable in a unifirm manner so that the toilet user can flush the toilet 10 by moving the thumb wheel 108 to the "on" position, subsequently depressing the actuating cap 66 and maintaining the actuating cap 66 in a depressed position for a desired period of time necessary to accomplish complete flushing of the bowl 16. The operation of the actuator cap 66 can be repeated over the service life of th toilet 10 with the knowledge that each flushing cycle will be a predictable repeat of previous cycle. The uniformity of operation is desirable from the standpoint of economic use of water from the tank 22 and economic use of the batteries 76 over a prolonged service life.

When the batteries 76 become low enough to consider replacement, but prior to the time batteries become so low that they will not operate the circuit 86, the light 92 will so indicate.

The elements and operation of the circuit 86 will now be described with reference to FIG. 10. The circuit 86 performs the functions of providing an indication of low battery voltage and modulates the voltage applied to the motor 56 to provide a pulsed water output, as previously described. The circuit 86 is divided into two functional subcircuits, a low battery indicator circuit 151, and a pulsing circuit 152, both carried by the circuit board 80.

The low battery indicator circuit 151 includes a voltage detector 154 which is powered by battery voltage flowing through a diode 156. The voltage detector 154 provides a constant voltage output at the terminal 158 while the battery voltage is within a given range. If however, battery voltage falls below a predetermined level, the terminal 158 is turned off. The signal from terminal 158 is applied to the base terminal of the transistor 160. The emitter of the transistor 160 is at battery voltage once the switch 96 is closed. The low battery warning LED 92 is connected between battery ground and the collector of the transistor 160.

In operation, the transistor 160 acts as a switch controls current flow through the LED 92, based on the signal applied by the voltage detector 154. When the switch 96 is open, no current flows through the LED 92. When the switch 96 is closed while the battery voltage is at a high level, th voltage detector 154 provides a signal which prevents current flow through the LED 92. If, however, battery voltage applied to the emitter terminal goes below a predetermined level, terminal 158 is turned off which allows current to flow through LED 92 causing it to illuminate. Accordingly, the low battery indicator circuit 151 provides a visual indication to the user of a low battery voltage condition.

The pulsing circuit 152 includes three series connected op-amps or inverts 162, 164, and 166. A feedback signal is applied to inverter 162 through resistor 172 from the output of inverter 164 through a capacitor 168, and from the output of inverter 166 through a resistor 170. Since the charging of the capacitor 168 is time dependent, the feedback voltage applied to the inverter 162 changes with respect to time, causing the output from invertor 166 to be a square wave with its period determined by the values of the capactor 168 and the resistors 170 and 172. The transistors 174 and 176 act as switches which handle motor current. The positive terminal of the motor is normally connected directly to the battery positive terminal while the ground connection is switched by the circuit to provide the desired pulsed output.

From the above description it is seen that this invention provides a portable toilet 10 which includes a battery operated flush assembly. Furthermore, the battery operated flush assembly provides for a "plused" action of the flush water in the toilet bowl to provide for more efficient and improved flushing action. This is accomplished by using the improved axial flow pump which operates to lift relatively small amounts of water relatively short distances and pulse it into the toilet bowl. All of these advantages are obtained while still maintaining efficient use of the batteries that operate the flush mechanism and without risking leaking of the flush water from the toilet during transport.

What is claimed is:

1. In a portable toilet which includes a seat section having a bowl with a bottom discharge opening and a chamber containing flush water for rinsing said bowl and flushing the contents thereof through said discharge opening, pump means communicating with said flush water chamber and operable to move water therefrom into said bowl, electric motor means drivingly connected to said pump means, battery means mounted on said seat section and electrically connected to said motor means and conduit means operable to convey flush water from said pump means upwardly to said bowl, said bowl having a generally horizontal ledge at the upper end thereof, said conduit means being operable to discharge flush water in a generally horizontal direction onto said ledge so that it will travel around the periphery of said bowl on said ledge, and means for operating said pump intermittently so that pulses of flush water are discharged onto said ledge, said water in each pulse initially moving onto said ledge at a high velocity and as the water moving on the ledge loses its momentum, and as the velocity of the water decreases, the centrifugal force of the water that is holding it on the ledge decreases and the water gradually runs off said ledge around substantially the entire periphery of said bowl to uniformly wet said bowl, said water pulses being substantially uniform with one another to provide predictability to each flush cycle of said toilet.

2. In a toilet which includes a seat section having a bowl with a bottom discharge opening and a flush water discharge means for discharging flush water into said bowl for flushing waste in said bowl through said discharge opening, said bowl having a generally horizontal ledge at the upper end thereof, said discharge means being operable of discharge flush water in a generally horizontal direction onto said ledge so that it will travel around the periphery of said bowl on said ledge, and means for operating said discharge means intermittently so that pulses of flush water can be discharged onto said ledge, said water in each pulse initially moving onto said ledge at a high velocity and as the water moving on the ledge loses it momentum, and as the velocity of the water decreases, the centrifugal force of the water that is holding it on the ledge decresed and the water gradually runs off said ledge around substantially the entire periphery of said bowl to uniformly wet said bowl.

* * * * *

UNITED STATES PATENT AND TRADEMARK OFFICE

CERTIFICATE OF CORRECTION

PATENT NO. : 5,010,602

DATED : April 30, 1991

INVENTOR(S) : Charles L. Sargent, John M. Antos

It is certified that error appears in the above-identified patent and that said Letters Patent is hereby corrected as shown below:

Column 8, line 40, Claim 2, kindly delete "decreased", and insert --decreases--.

Column 1, line 46, kindly delete "diredted", and insert --directed--.

Column 2, line 15, kindly delete "toil", and insert --toilet--.

Column 2, line 25, kindly delete "On", and insert --One--.

Column 2, line 32, kindly delete "oven", and insert --open--.

Column 2, line 64, kindly delete "connectin", and insert --connection--.

Column 3, line 19, kindly delete "illustrationg", and insert --illustrating--.

Column 3, line 39, kindly delete "depositied", and insert --deposited--.

Column 4, line 30, kindly delete "circit", and insert --circuit--.

Column 4, line 39, before "84", kindly insert --opening--.

Column 4, line 46, kindly delete "cntinuously", and insert --continuously--.

Column 4, line 51, kindly delete "pulshed", and insert --pulsed--.

UNITED STATES PATENT AND TRADEMARK OFFICE

CERTIFICATE OF CORRECTION

PATENT NO. : 5,010,602

DATED : April 30, 1991

INVENTOR(S) : Charles L. Sargent, John M. Antos

It is certified that error appears in the above-identified patent and that said Letters Patent is hereby corrected as shown below:

Column 6, line 14, kindly delete "throughly", and insert --thoroughly--.

Column 6, line 27, kindly delete "unifirm", and insert --uniform--.

Column 6, line 34, kindly delete "th", and insert --the--.

Column 7, line 2, kindly delete "th", and insert --the--.

Signed and Sealed this

Twenty-seventh Day of October, 1992

*Attest:*

DOUGLAS B. COMER

*Attesting Officer*

*Acting Commissioner of Patents and Trademarks*